US007549190B2

(12) United States Patent
Oh et al.

(10) Patent No.: US 7,549,190 B2
(45) Date of Patent: Jun. 23, 2009

(54) NOZZLE ASSEMBLY OF VACUUM CLEANER

(75) Inventors: Jang-Keun Oh, Gwangju (KR); Dong-Houn Yang, Gwangju (KR); Hyoun-Soo Kim, Busan (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 0 days.

(21) Appl. No.: 11/975,286

(22) Filed: Oct. 18, 2007

(65) Prior Publication Data

US 2008/0289141 A1 Nov. 27, 2008

(30) Foreign Application Priority Data

May 23, 2007 (KR) ..... 10-2007-0050388

(51) Int. Cl.
*A47L 5/30* (2006.01)

(52) U.S. Cl. ..... 15/364; 15/365; 15/369

(58) Field of Classification Search ..... 15/355, 15/364, 365, 360, 369, 415.1–422.1; *A47L 5/00, A47L 5/30*

See application file for complete search history.

(56) References Cited

U.S. PATENT DOCUMENTS 3,220,043 A * 11/1965 Lampe ..... 15/340.2
7,150,068 B1 * 12/2006 Ragner ..... 15/340.2
2006/0277713 A1 * 12/2006 Sandlin et al. ..... 15/387

* cited by examiner

*Primary Examiner*—David A Redding
(74) *Attorney, Agent, or Firm*—Ohlandt, Greeley, Ruggiero & Perle, L.L.P.

(57) ABSTRACT

A nozzle assembly of a vacuum cleaner is disclosed. The nozzle assembly includes a nozzle assembly body having an air inlet and an air outlet, a drum brush unit disposed in the nozzle assembly body in the vicinity of the air inlet, and having a drum brush disposed to brush away dirt or dust adhered to a surface to be cleaned while coming in rotation contact therewith, and a movable brush unit disposed in at least one of the front and the rear of the air inlet on an undersurface of the nozzle assembly body to pivot in an opposite direction to a moving direction of the nozzle assembly body thus to change a contacting angle to the surface to be cleaned in the range of a predetermined angle and then to brush away dirt or dust adhered to the surface to be cleaned, in moving of the nozzle assembly body.

12 Claims, 10 Drawing Sheets

NOZZLE ASSEMBLY OF VACUUM CLEANER

CROSS-REFERENCE TO RELATED APPLICATIONS

This application claims the benefit under 35 U.S.C. § 119 (a) of Korean Patent Application No. 10-2007-0050388, filed on May 23, 2007, in the Korean Intellectual Property Office, the entire content of which is hereby incorporated by reference.

BACKGROUND OF THE INVENTION

1. Field of the Invention

The present disclosure relates to a vacuum cleaner. More particularly, the present disclosure relates to a nozzle assembly of a vacuum cleaner, which comes in contact with a surface to be cleaned to draw in dust or dirt with air from the surface to be cleaned.

2. Description of the Related Art

In general, a vacuum cleaner is provided with a nozzle assembly capable of drawing in dust or dirt from a surface to be cleaned. Such a nozzle assembly draws in the dirt or the dust from the surface to be cleaned by a suction force generated from a suction motor mounted in a cleaner body in a state where it comes in contact with the surface to be cleaned.

Such a conventional nozzle assembly has a drum brush disposed in an air inlet to scrape off the dust or dirt adhered to the surface to be cleaned thus to efficiently brush away the dust or dirt therefrom. The drum brush is rotated by a motor mounted in the nozzle assembly or by a kinetic energy of drawn-in air. A brush member or blade projected from an outer circumferential surface of the drum brush scrapes against the surface to be cleaned while coming in rotation contact therewith. When the brush member or blade scrapes against a portion of the surface to be cleaned, which is stained with the dust or dirt, the dust or dirt is scattered while separating from the portion of the surface to be cleaned, and is drawn into the nozzle assembly by a suction force of the suction motor.

However, since the conventional nozzle assembly scrapes against the surface to be cleaned only by the drum brush, dirt, such as a particle or the like, which is adhered to the surface to be cleaned, is separated well, but dirt, such as a hair, fur of a pet or the like, which is firmly stuck to the surface to be cleaned, particularly, a surface of carpet, is not separated well. That is, although the drum brush scrapes against the surface to be cleaned while rotating, scraping strength thereof is too weak to separate the dirt from the surface to be cleaned. Particularly, if spidery dirt, such as the hair, the fur or the like, is wound on cilia of the carpet, it is not easily separated from the carpet. In this case, there is an inconvenience in that to clean the carpet, a user should take the spidery dirt off one by one from the carpet, or clean the carpet again by using a cleaning outfit, such as a comb or the like.

In addition, the conventional nozzle assembly is provided with a connecting unit to join or separate an extended tube of a cleaner body to or from the nozzle assembly. One of such conventional connecting units include a ring connector installed in the extended tube, and a connecting pipe formed on the nozzle assembly to have a diameter larger than that of the extended tube thus to accommodate the extended tube. The ring connector has a fixing protrusion projected outward from an outer circumferential surface of the extended tube through an inserting hole of the extended tube, and the connecting pipe has a fixing hole formed in a position corresponding to the inserting hole of the extended tube to accommodate the fixing protrusion. Accordingly, if a user wants to join the extended tube of the cleaner body to the nozzle assembly, she or he inserts the extended tube into the connecting pipe. Then, the fixing protrusion is locked in the fixing hole and thus the extended tube and the nozzle assembly are joined to each other. To the contrary, if the user wants to separate the extended tube of the cleaner body from the nozzle assembly, she or he pushes the fixing protrusion with one hand. Then, the ring connector is deformed to allow the fixing protrusion to push in toward the inside of the connecting pipe, and thus the locking connection between the extended tube and the nozzle assembly is released. Under this state, when the user pulls the extended tube with the other hand, the extended tube is separated from the connecting pipe.

However, according to the conventional connecting unit described above, since when the user separates the extended tube from the connecting pipe, she or he should work using both hands with her or his body bent, it is very inconvenient to handle.

Also, the conventional nozzle assembly is configured, so that a nozzle assembly body is formed as a single body of plastic material. Accordingly, a problem may occur, in that in cleaning, the nozzle assembly body is easily damaged or scratched when it comes in collision with an external structure, such as an obstacle.

SUMMARY OF THE INVENTION

An aspect of the present disclosure is to address at least the above problems and/or disadvantages and to provide at least the advantages described below. Accordingly, an aspect of the present disclosure is to provide a nozzle assembly of a vacuum cleaner capable of more efficiently cleaning dust or dirt, which is firmly stuck to a surface to be cleaned.

Another aspect of the present disclosure is to provide a nozzle assembly of a vacuum cleaner having a connecting unit capable of being easily joined to and separated from a connecting part of a cleaner body.

Further another aspect of the present disclosure is to provide a nozzle assembly of a vacuum cleaner having various additional functions, thereby allowing the nozzle assembly to be easily used.

In accordance with an aspect of the present disclosure, a nozzle assembly of a vacuum cleaner includes a nozzle assembly body having an air inlet and an air outlet, a drum brush unit disposed in the nozzle assembly body in the vicinity of the air inlet, and having a drum brush disposed to brush away dirt or dust adhered to a surface to be cleaned while coming in rotation contact therewith, and a movable brush unit disposed in at least one of the front and the rear of the air inlet on an undersurface of the nozzle assembly body to pivot in an opposite direction to a moving direction of the nozzle assembly body thus to change a contacting angle to the surface to be cleaned in the range of a predetermined angle and then to brush away dirt or dust adhered to the surface to be cleaned, in moving of the nozzle assembly body.

Here, the movable brush unit may include a first movable brush member disposed in front of the air inlet, and a second movable brush member disposed in the rear of the air inlet.

Each of the first and the second movable brush members may include a supporting part rotatably supported in a first or a second mounting groove formed in the undersurface of the nozzle assembly body adjacent to the front or the rear of the air inlet and having a brush attached to an undersurface thereof, and at least one contact rotating part disposed on the undersurface of the supporting part to come in contact with the surface to be cleaned thus to rotate the supporting part in the opposite direction to the moving direction of the nozzle assembly body, in the moving of the nozzle assembly body.

The supporting part may have a plurality of rotation supporting surfaces rotatably supported in a spaced-apart relation to each other by a plurality of hinge brackets disposed in the first or the second mounting groove.

The contact rotating part may include a cam fixed on the undersurface of the supporting part, so that a rotating angle thereof is restricted in the predetermined angle by a front wall surface and a rear wall surface of the first or the second mounting groove. Preferably, but not necessarily, the cam is formed in a V-lettered shape having first and second contacting surfaces formed, so that when one is rotated coming in contact with the surface to be cleaned, the other comes in contact with the front wall surface or the rear wall surface of the corresponding first or second mounting groove to restrict a rotation of the cam. Also, preferably, but not necessarily, the predetermined angle is an angle of 30 degrees.

Alternatively, both ends of the supporting part of the first movable brush member may be bent and extended toward both sides of the air inlet. In this case, the nozzle assembly body at both sides thereof has guide grooves formed to guide the both ends of the supporting part to rotate in the predetermined angle.

To prevent the nozzle assembly body from being damaged or scratched in a collision with an external structure, such as an obstacle, the nozzle assembly body may have a drum brush casing formed of one of a rubber and a plastic material of PVC series to surround the drum brush in a front thereof. At this time, the drum brush casing may have a transparent window to expose the drum brush to the outside thus to perceive a condition of the drum brush.

To connect the nozzle assembly body to a connecting part of a cleaner body, the nozzle assembly may further include a connecting unit. Preferably, but not necessarily, the connecting unit includes a connecting pipe connected with an air passage of the nozzle assembly body and projected upward from an upper surface of the nozzle assembly body, a push lever rotatably supported on a fixing mount formed on one side of the connecting pipe and urged to come in contact with the connecting pipe by an elastic spring, and a locking pin formed on one surface of the push lever opposed to the connecting pipe and inserted into locking holes of the connecting pipe and the connecting part.

Also, to adjust a height of the drum brush unit according to a condition of the surface to be cleaned, the nozzle assembly may further include a height adjusting unit.

BRIEF DESCRIPTION OF THE DRAWING FIGURES

The above and other objects, features, and advantages of certain exemplary embodiment of the present disclosure will be more apparent from the following description taken in conjunction with the accompanying drawings, in which.

Throughout the drawings, the same reference numerals will be understood to refer to the same elements, features, and structures.

DETAILED DESCRIPTION OF THE EXEMPLARY EMBODIMENTS

Hereinafter, a nozzle assembly of a vacuum cleaner according to an exemplary embodiment of the present disclosure will be described in detail with reference to the accompanying drawing figures.

Figure 9:
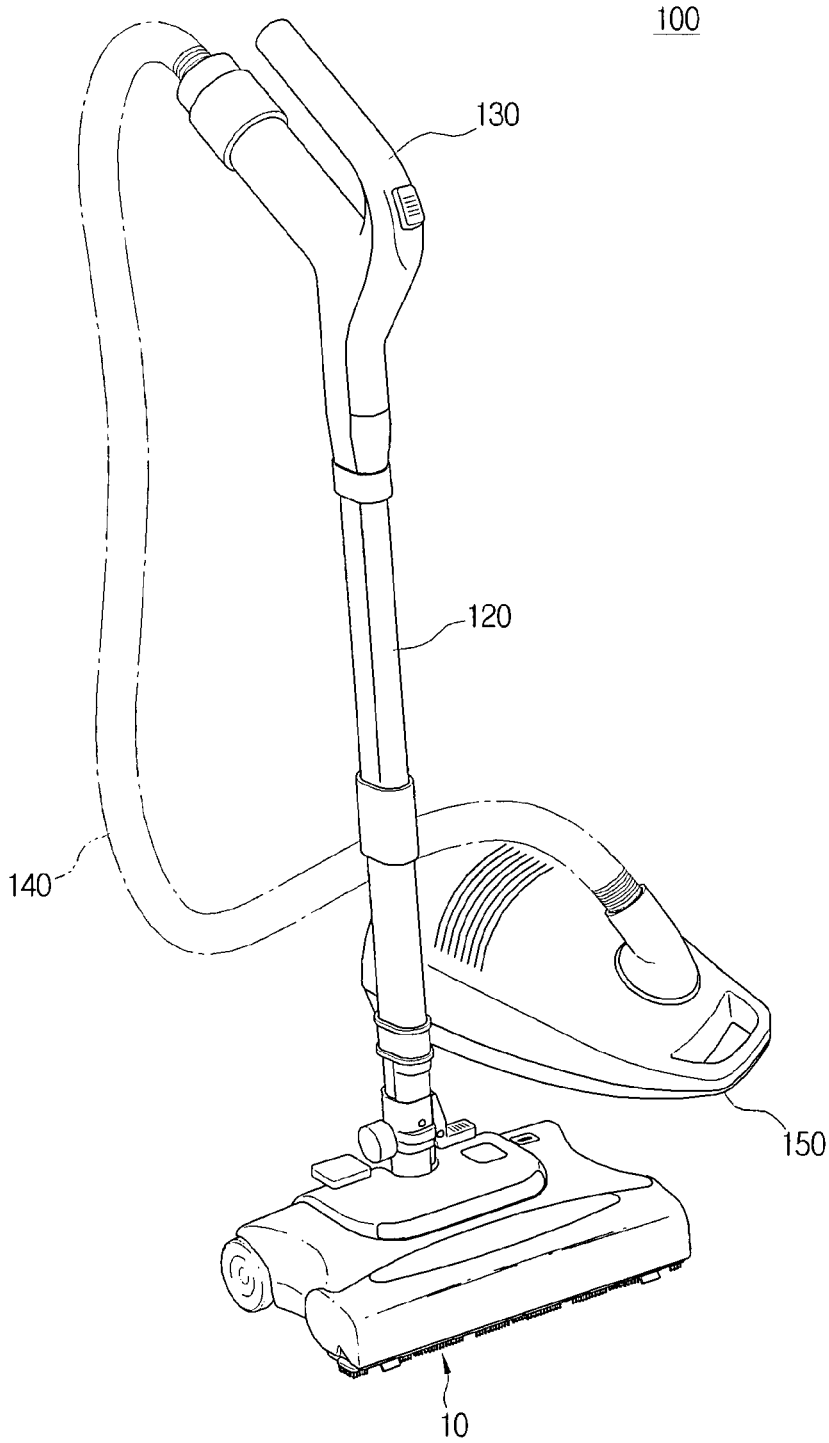
FIG. 9 is a perspective view exemplifying a vacuum cleaner to which the nozzle assembly illustrated in FIG. 1 is applied.

FIG. 9 is a perspective view exemplifying an example of a vacuum cleaner 100 to which a nozzle assembly 10 according to an exemplary embodiment of the present disclosure is applied Referring to FIG. 9, the vacuum cleaner 100 includes a nozzle assembly 10 to draw in air laid with dust or dirt, a telescopically extended tube 120 connected to the nozzle assembly 10, an operating handle 130, a suction hose 140 connected to the operating handle 130, and a cleaner body 150 connected to the suction hose 140 and divided into a dust separating chamber (not illustrated) and a motor chamber (not illustrated).

Figure 1:
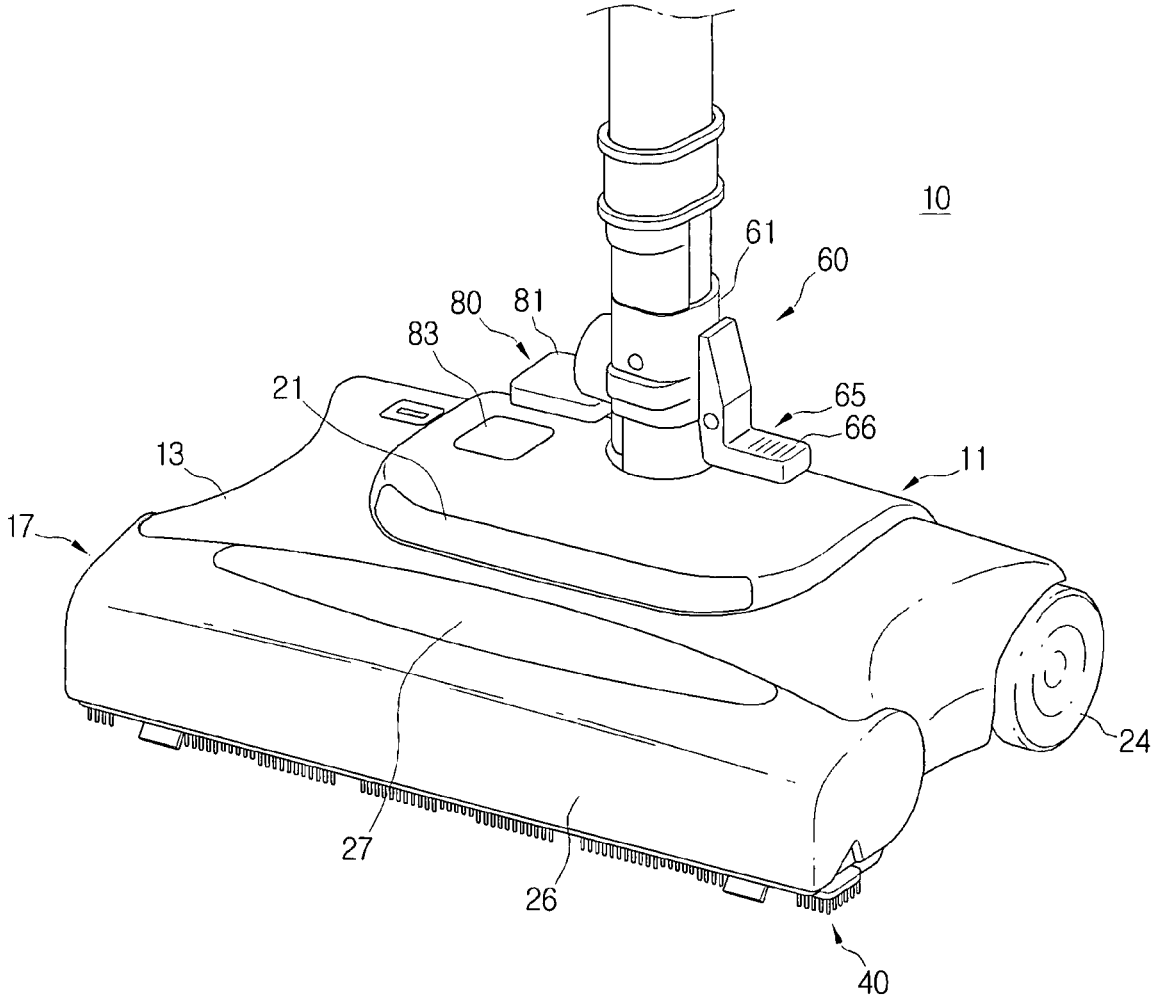
FIG. 1 is a perspective view exemplifying a nozzle assembly of a vacuum cleaner according to an exemplary embodiment of the present disclosure.
Figure 2:
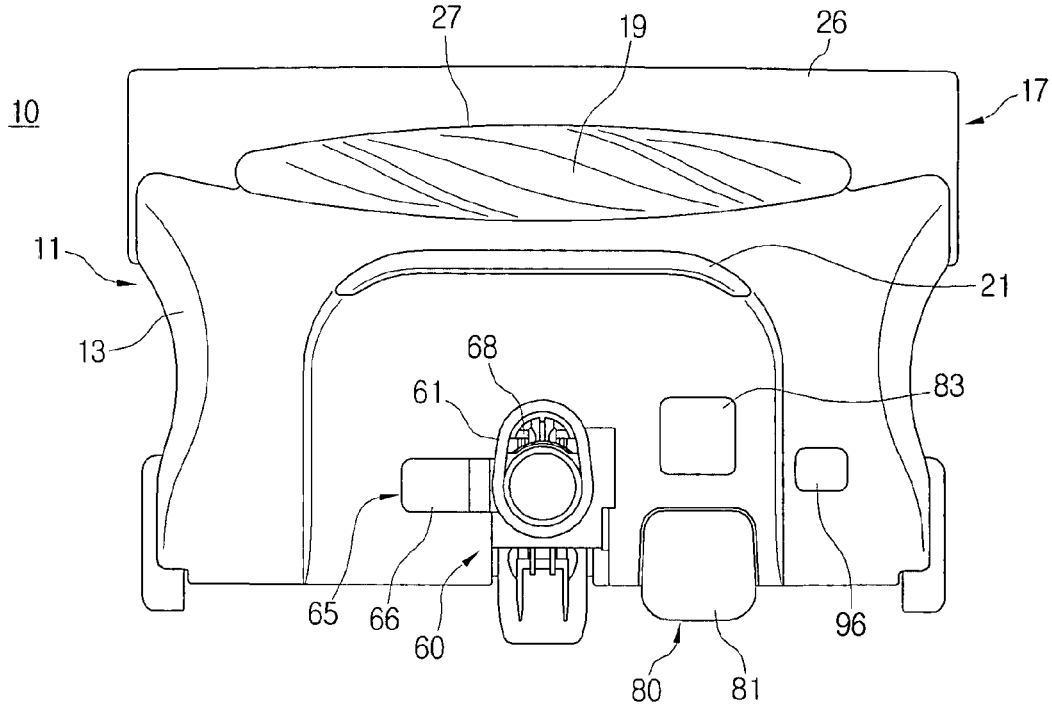
FIG. 2 is a top plan view of the nozzle assembly of FIG. 1.
Figure 3:
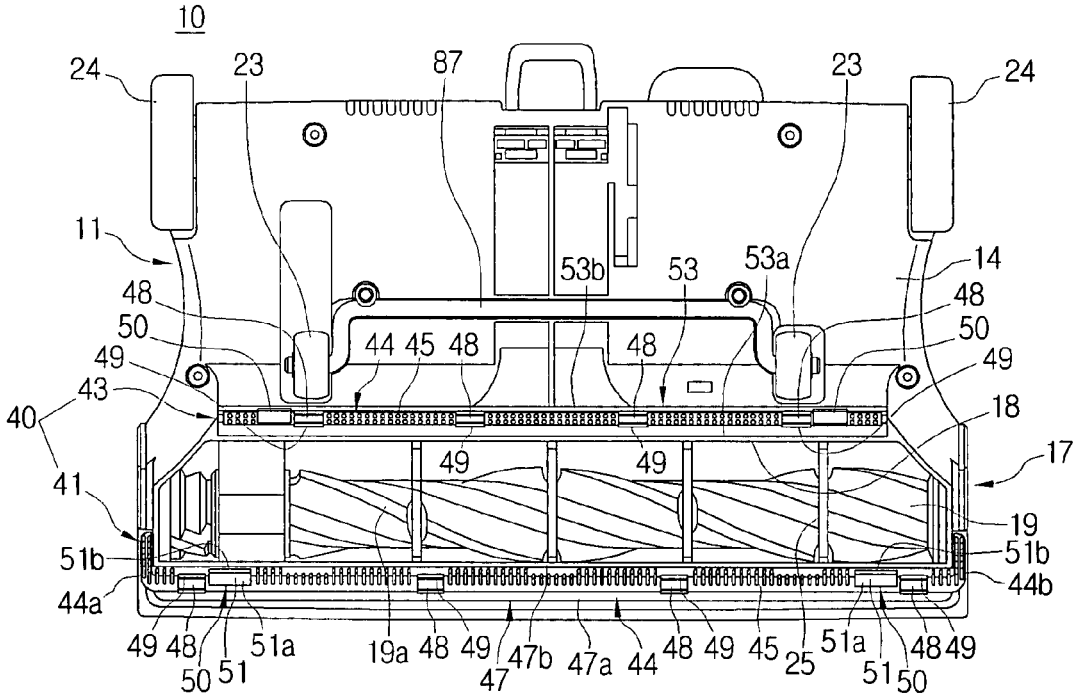
FIG. 3 is a bottom view of the nozzle assembly of FIG. 1.

FIGS. 1, 2 and 3 are a perspective view, a top plan view and a bottom view exemplifying the nozzle assembly 10 of the vacuum cleaner according to the exemplary embodiment of the present disclosure.

As illustrated in FIGS. 1 through 3, the nozzle assembly 10 of the according to the exemplary embodiment of the present disclosure includes a nozzle assembly body 11, a drum brush unit 17, a movable brush unit 40, a connecting unit 60, and a height adjusting unit 80.

The nozzle assembly body 11 is made up of upper and lower casings 13 and 14. The upper and the lower casings 13 and 14 are joined with each other by screws and the like. In the upper and the lower casings 13 and 14 are formed an air passage (not illustrated), which is connected to an air inlet 18 (see FIG. 3) formed in the drum brush unit 17. Accordingly, when a vacuum motor (not illustrated) mounted in the cleaner body 150 generates a suction force, dust or dirt along with air is drawn in through the air inlet 18, and flown into the cleaner body 150 through an air outlet of the connecting unit 60 located in the rear of the nozzle assembly body 11 via the air passage of the upper and the lower casings 13 and 14.

In addition, a driving motor (not illustrated), which drives a drum brush 19, is disposed in the upper and the lower casings 13 and 14 of the nozzle assembly body 11. Alternatively, instead of the driving motor, a turbine, which is rotated by the drawn-in air, can be disposed in the upper and the lower casings 13 and 14.

To illuminate a dark place in cleaning, a lamp 21 is disposed in the middle of the upper casing 13, and to easily move the nozzle assembly 10, a pair of wheels 24 are installed in the rear of the upper and the lower casings 13 and 14.

The drum brush unit 17 includes a drum brush casing 26, and a drum brush 19. The drum brush casing 26 has the drum brush 19 disposed therein. The drum brush casing 26 is made up of a member separately formed from the upper casing 13 of the nozzle assembly body 11. To prevent the drum brush casing 26 from being damaged or scratched in collision with an external structure, such as an obstacle, it is formed of a rubber or a plastic material of PVC series. At this time, preferably, but not necessarily, the drum brush casing 26 has a transparent window 27 formed in a longitudinal direction in an upper surface thereof to expose the drum brush 19 to the outside thus to allow a user to perceive a condition of the drum brush 19. The air inlet 18 is formed in the lower casing 14 of the nozzle assembly body 11 joined with the drum brush casing 26, so that it can draw in the dust or dirt and the air. To prevent a patch of quilt or cloth among the air laden with the dust or dirt from flowing into the nozzle assembly body 11, a plurality of ribs 25 is formed to cross the air inlet 18.

The drum brush 19 strikes a surface to be cleaned in a tangential direction while coming in rotation contact with the surface to be cleaned and thus brushes away the dust or dirt adhered to the surface to be cleaned. For this, the drum brush 19 is formed in the form of a drum, and has a plurality of furs or blade members 19*a* implanted in an approximately spiral shape on an outer circumferential surface thereof. The drum brush 19 is rotatably disposed in the lower casing 14. The drum brush 19 may be connected to the driving motor described above.

In moving of the nozzle assembly body 11, the movable brush unit 40 pivots in an opposite direction to a moving direction of the nozzle assembly body 11 thus to change a contacting angle to the surface to be cleaned in the range of a predetermined angle and then brushes away dirt or dust adhered to the surface to be cleaned. As illustrated in FIG. 3, the movable brush unit 40 includes first and second movable brush members 41 and 43 disposed in the vicinity of the air inlet 18 of the lower casing 14 of the nozzle assembly body 11.

The first movable brush member 41 is located in front of the air inlet 18, and the second movable brush member 43 is located in the rear of the air inlet 18.

The first movable brush member 41, which brushes or scrapes away the dust or dirt, such as particles, a hair, fur of pet or the like, adhered to the surface to be cleaned, is made up of a supporting part 44 and two contact rotating parts 50. The supporting part 44 is formed in the form of an elongated bar having a brush 45 attached on an undersurface thereof. The brush 45 is formed of a rubber plate having a plurality of protrusions. The supporting part 44 is rotatably supported in a first mounting groove 47 formed in an undersurface of the lower casing 14 of the nozzle assembly body 11 adjacent to the front of the air inlet 18. For this, the supporting part 44 has four rotation supporting surfaces 48 formed in a spaced-apart relation to each other.

The four rotation supporting surfaces 48 are rotatably supported by four hinge brackets 49 disposed in the first mounting groove 47, respectively. At this time, spaces above the rotation supporting surfaces 48 form spaces through which due to the suction force of the suction motor of the cleaner body 150, relatively dust or dirt draws in and passes, respectively.

Alternatively, the rotation supporting surfaces 48 can be rotatably supported by four hinge protrusions (not illustrated) projected inside the first mounting groove 47 from an upper part of a front wall surface 47*a* or a rear wall surface 47*b* of the first mounting groove 47, instead of the hinge brackets 49.

Both ends 44*a* and 44*b* of the supporting part 44 are bent and extended toward both sides of the air inlet 18 to brush or scrape away the dust or dirt adhered to the surface to be cleaned on the both sides of the air inlet 18. At this time, to allow the both ends 44*a* and 44*b* to rotate in a predetermined angle, for example, an angle of approximately 30 degrees, guide grooves 31 (see FIG. 4A) are formed on both sides of the drum brush casings 26 of the nozzle assembly body 11.

The two contact rotating parts 50 are fixed to an undersurface of the supporting part 44 adjacent to the rotation supporting surfaces 48 located in the vicinity of the both ends 44*a* and 44*b* of the supporting part 44, so that in the moving of the nozzle assembly body 11, they come in contact with the surface to be cleaned thus to rotate the supporting part 44 in the opposite direction to the moving direction of the nozzle assembly body 11. Each of the two contact rotating parts 50 can be formed of a cam 51 fixed on the undersurface of the supporting part 44, so that a rotating angle thereof is restricted in the predetermined angle, that is, the angle of approximately 30 degrees, by the front wall surface 47*a* and the rear wall surface 47*b* of the first mounting groove 47. Preferably, but not necessarily, the cam 51 is formed of a rubber member of a V-lettered shape having first and second contacting surfaces 51*a* and 51*b* formed, so that when one is rotated coming in contact with the surface to be cleaned, the other comes in contact with the corresponding front or the rear wall surface 47*a* or 47*b* of the first mounting groove 47 to restrict a rotation of the cam 51. At this time, an elastic force of the first and the second contacting surfaces 51*a* and 51*b*, an angle between the first and the second contacting surfaces 51*a* and 51*b*, and distances between the first and the second contacting surfaces 51*a* and 51*b* and the front and the rear wall surfaces 47*a* and 47*b* are set, so that the cam 51 of the contact rotating parts 50 is moved in the range of the predetermined angle, that is, the angle of 30 approximately degrees when it is rotated in contact with the surface to be cleaned.

The second movable brush member 43 has the same construction as that of the first movable brush member 41, except that it is installed in a second mounting groove 53 formed on the undersurface of the lower casing 14 of the nozzle assembly body 11 adjacent to the rear of the air inlet 18 and both ends of the supporting part 44 are not bent and extended toward both sides of the drum brush 19, but formed in an I-lettered shape. Accordingly, a detailed description on the construction of the second movable brush member 43 will be omitted.

Figure 7A:
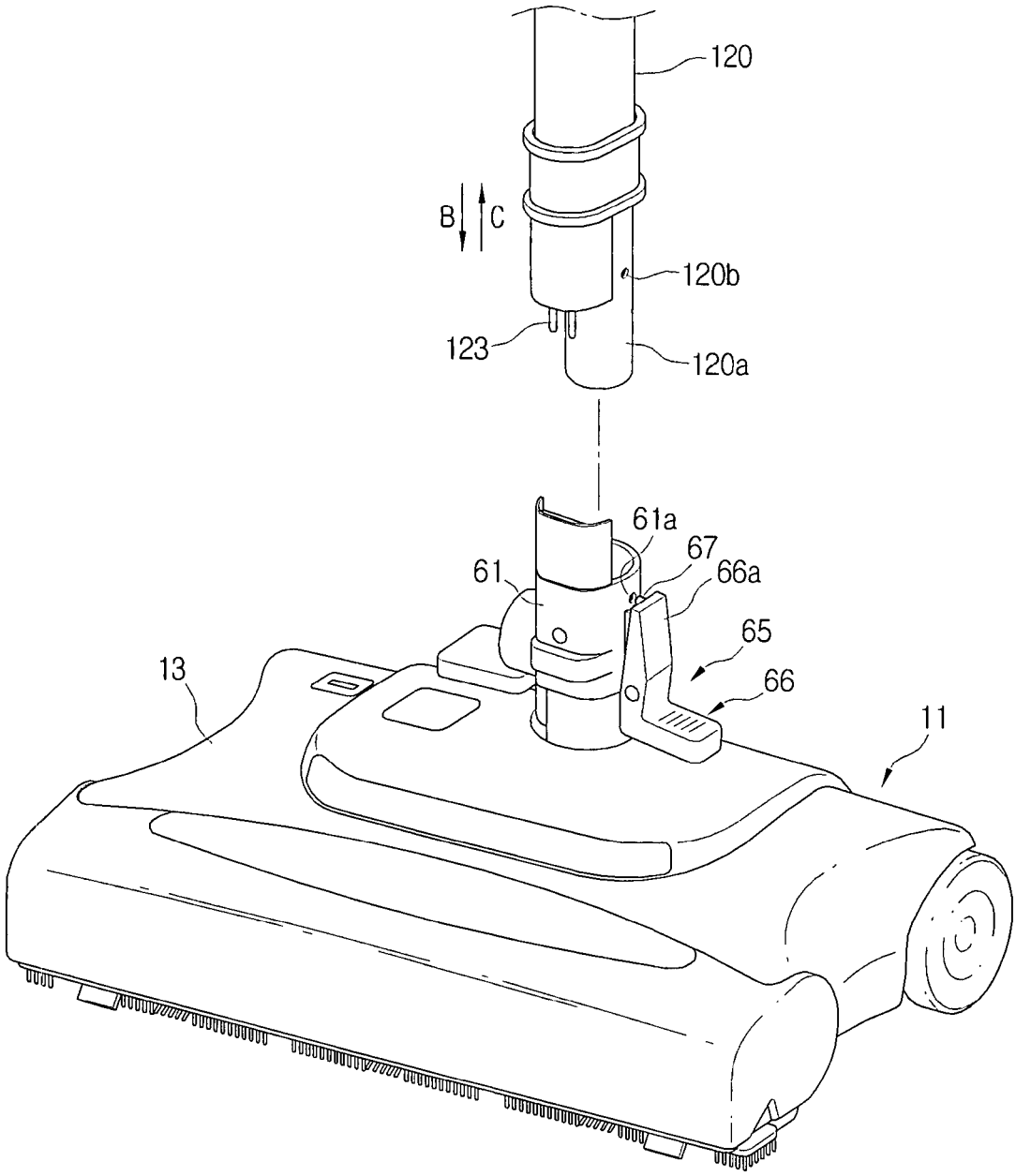
FIGS. 7A and 7B are perspective views exemplifying an operation of the connecting unit of the nozzle assembly of FIG. 1.
Figure 7B:
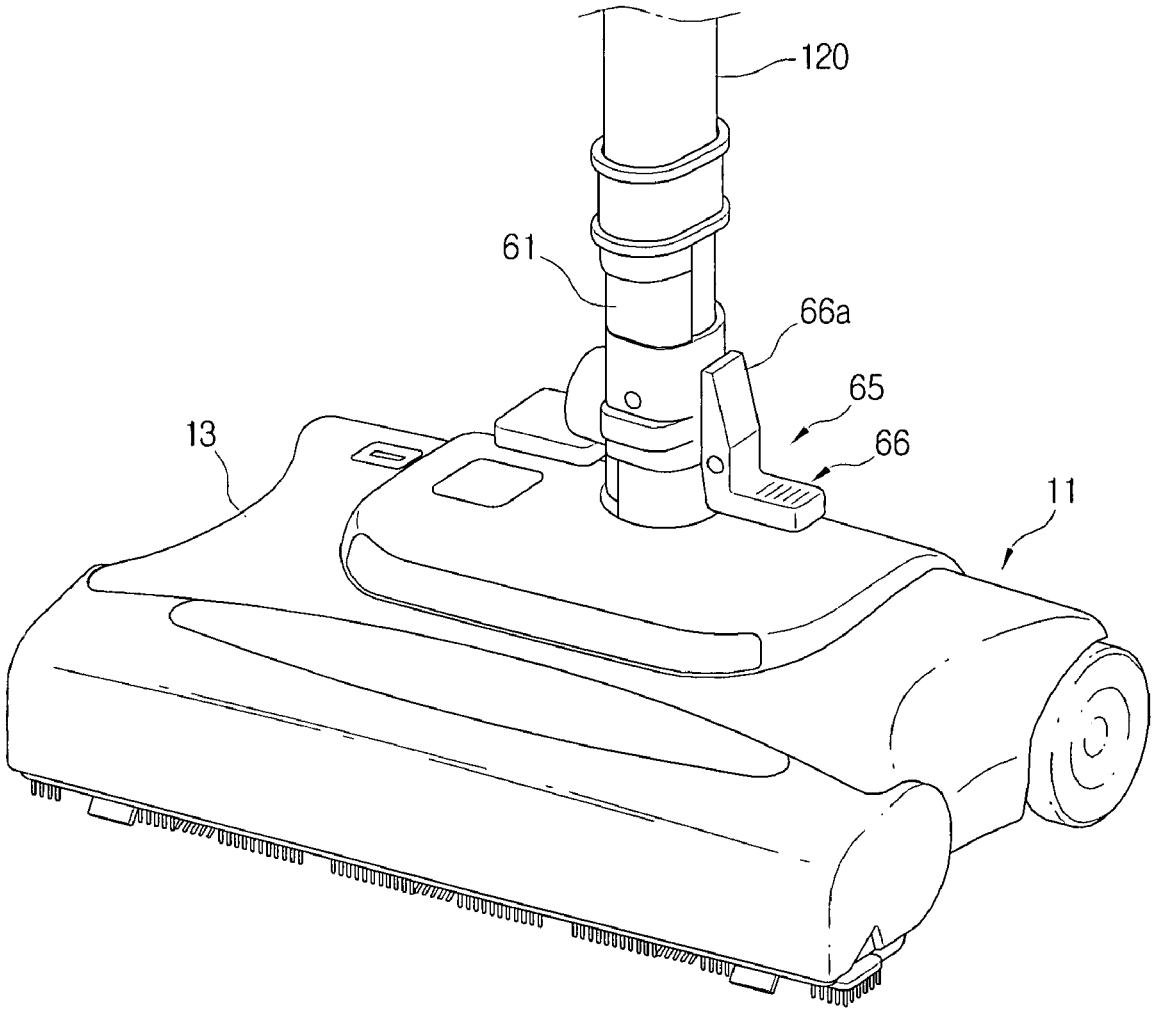

Referring to FIGS. 1, 7A and 7B, the connecting unit 60 is provided with a connecting pipe 61 projected upward from an upper surface of the upper casing 13 of the nozzle assembly body 11 in the middle of the rear of the upper casing 13. The connecting pipe 61 is connected with the air passage of the upper and the lower casings 13 and 14 of the nozzle assembly body 11 to form an air outlet, and has a wire (not illustrated) disposed therein so as not to be exposed to the outside. The wire is connected between the driving motor of the nozzle assembly body 11 and a terminal of a female socket (not illustrated) formed in an upper end of the connecting pipe 61. The female socket is joined with a male socket 123 formed in a lower end 120*a* of the extended tube 120 when the lower end 120*a* of the extended tube 120 is inserted into and assembled with the connecting pipe 61.

On one side of the connecting pipe 61 is disposed a locking part 65 to lock the lower end 120*a* of the extended tube 120 to the connecting pipe 61. The locking part 65 is provided with an L-lettered push lever 66 rotatably supported on an axis 64 (see FIG. 6) of a fixing mount 62 formed on the one side of the connecting pipe 61. The push lever 66 is urged in a direction where an upper end 66*a* thereof comes in contact with the connecting pipe 61, by an elastic spring, such as a torsion spring, installed on the axis 64. A locking pin 67 is formed on one surface of the upper end 66*a* of the push lever 66 opposed to the connecting pipe 61, and is inserted into a locking hole

61*a* of the connecting pipe 61 and a locking hole 120*b* (see FIG. 7A) of the lower end 120*a* of the extended tube 120.

Figure 6:
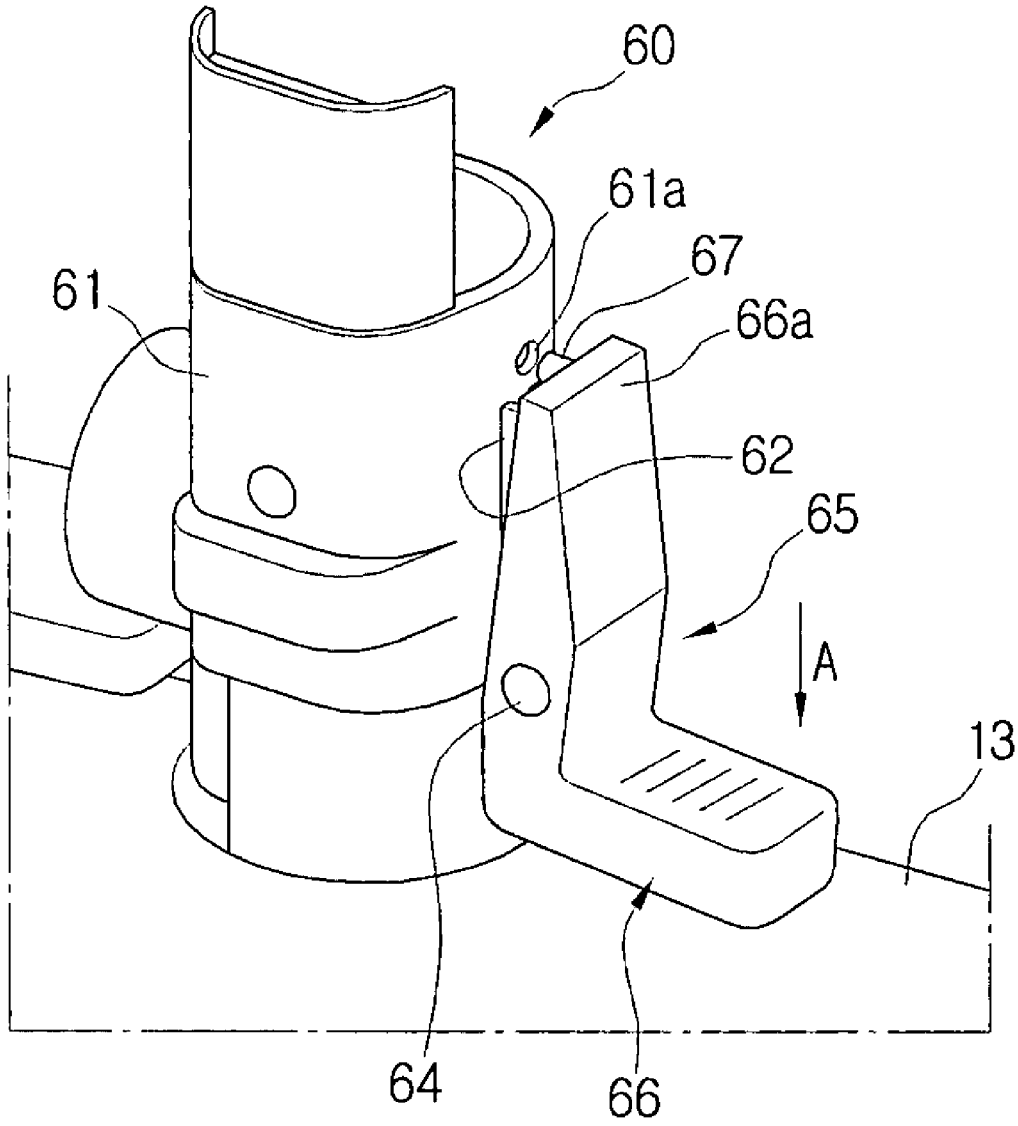
FIG. 6 is a partial perspective view exemplifying a connecting unit of the of the nozzle assembly of FIG. 1.

Accordingly, if a user wants to join the lower end 120*a* of the extended tube 120 to the connecting pipe 61, she or he inserts the male socket 123 formed in the lower end 120*a* of the extended tube 120 into the female socket formed in the upper end of the connecting pipe 61 in a direction of arrow B, as illustrated in 6, in a state where she or he pushes the push lever 66 in a direction of arrow A of FIG. 6 with her or his foot, as illustrated in FIG. 7A. And then, the user takes away her or his foot from the push lever 66 to remove a force applied on the push lever 66. As a result, the locking pin 67 of the push lever 66 is inserted in turn into the locking hole 61*a* of the connecting pipe 61 and the locking hole 120*b* of the lower end 120*a* of the extended tube 120, so that it locks the lower end 120*a* of the extended tube 120 in the upper end of the connecting pipe 61, as illustrated in FIG. 7B.

To the contrary, if the user wants to separate the lower end 120*a* of the extended tube 120 from the connecting pipe 61, she or he pushes the push lever 66 in the direction of arrow A of FIG. 6 with her or his foot, as illustrated in FIG. 6. According to this, the locking pin 67 of the push lever 66 is freed from the locking hole 61*a* of the connecting pipe 61 and the locking hole 120*b* of the lower end 120*a* of the extended tube 120 and thus the locking connection between the connecting pipe 61 and the lower end 120*a* of the extended tube 120 is released. Under this state, as illustrated in FIG. 7A, the user pulls up the lower end 120*a* of the extended tube 120 in a direction of arrow C. As a result, the male socket 123 of the lower end 120*a* of the extended tube 120 is separated from the female socket of the connecting pipe 61, so that the lower end 120*a* of the extended tube 120 is freed from the connecting pipe 61.

Referring to FIGS. 1, 3 and 8A through 8D, to adjust a height of the drum brush unit 17 according to a condition of the surface to be cleaned, the nozzle assembly 10 of the present disclosure further includes a height adjusting unit 80. The height adjusting unit 80 is provided with a height adjusting button 81, a lifting and lowering part (not illustrated) and a display part 83. The height adjusting button 81 is projected upward from the upper casing 13 in the vicinity of the connecting pipe 61 of the connecting unit 60, so that the user can push it with her or his foot. The lifting and lowering part lifts or lowers a wheel shaft 87 to which subsidiary wheels 23 are rotatably joined, in a plurality of steps, for example, four heights of high (HI), medium (MED), low (LO) and extra low (XLO), through a power transmitting part (not illustrated) according to the operation of the height adjusting button 81 by the user. The display part 83 displays the plurality of steps, that is, the four heights of high (HI), medium (MED), low (LO) and extra low (XLO), to which the wheel shaft 87 is lifted or lowered by the lifting and lowering part according to the operation of the height adjusting button 81. Since constructions and operations of the height adjusting unit 80 described above are the same as those of the conventional ones, detailed descriptions thereof will be omitted.

Referring to FIG. 2, on a right side of the height adjusting unit 80 is installed a reset switch 96 for overheating prevention. When the driving motor is stopped due to hanging or snagging of large dirt, such as a patch and the like, the reset switch 96 is used for re-operating the driving motor after the large dirt is removed.

Hereinafter, an operation of the nozzle assembly 10 according to the exemplary embodiment of the present disclosure will now be described with reference to FIGS. 1 through 9. In the description, it is assumed that the surface to be cleaned is, for example, a flat floor.

Figure 8A:
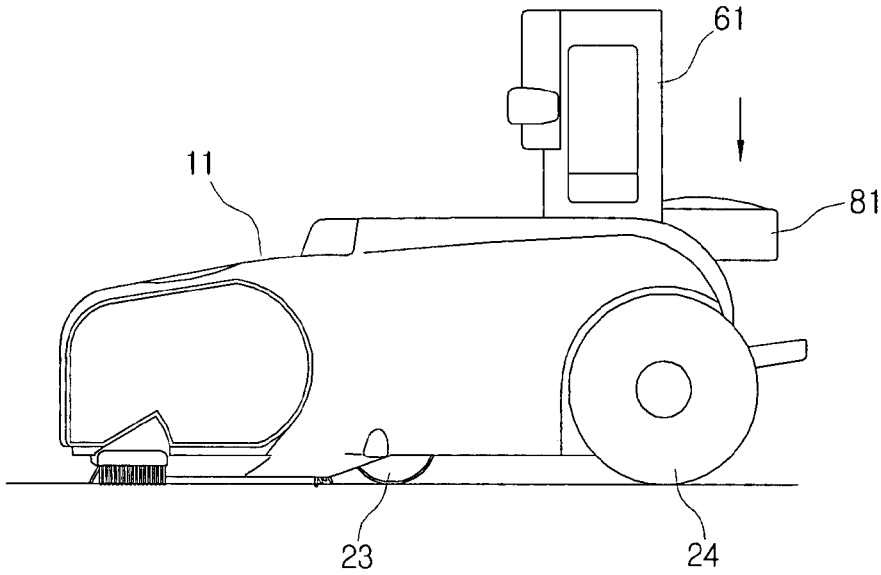
FIGS. 8A through 8D are side elevation views exemplifying an operation of a height adjusting unit of the nozzle assembly of FIG. 1.
Figure 8B:
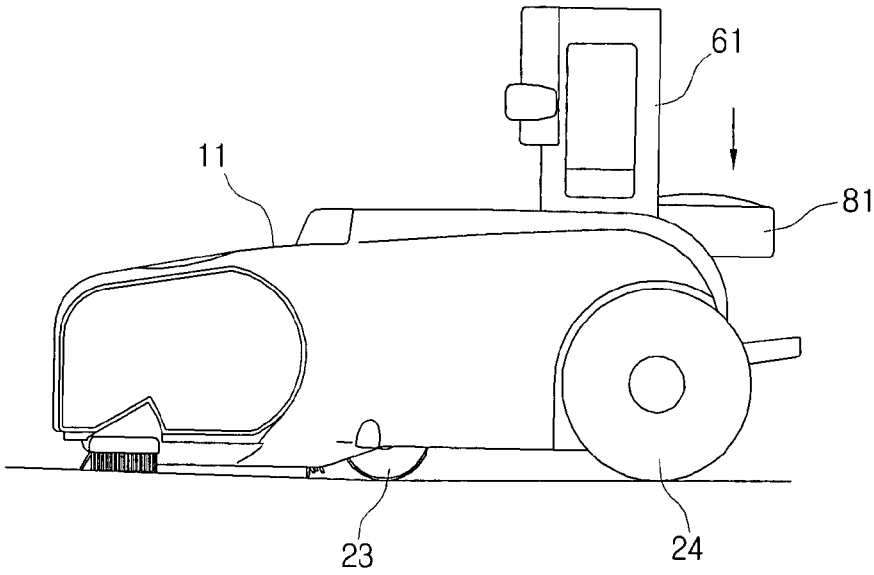

First, the user pushes the height adjusting button 81 with her or his foot, and thus adjusts a height of the drum brush unit 17 of the nozzle assembly 10 to a height of extra low (XLO) or low (LO) adapted to clean the flat floor, as illustrated in FIGS. 8A and 8B.

Subsequently, after the cleaner is applied with an electric power, the user moves the nozzle assembly 10 along the surface to be cleaned.

Figure 4A:
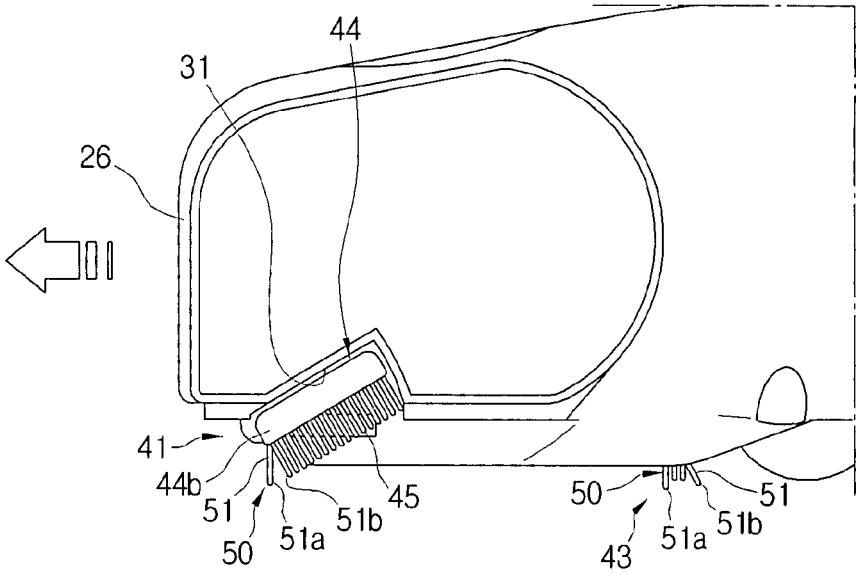
FIGS. 4A through 5B are side elevations and partial perspective views exemplifying an operation of a movable brush unit of the nozzle assembly of FIG. 1.
Figure 4B:
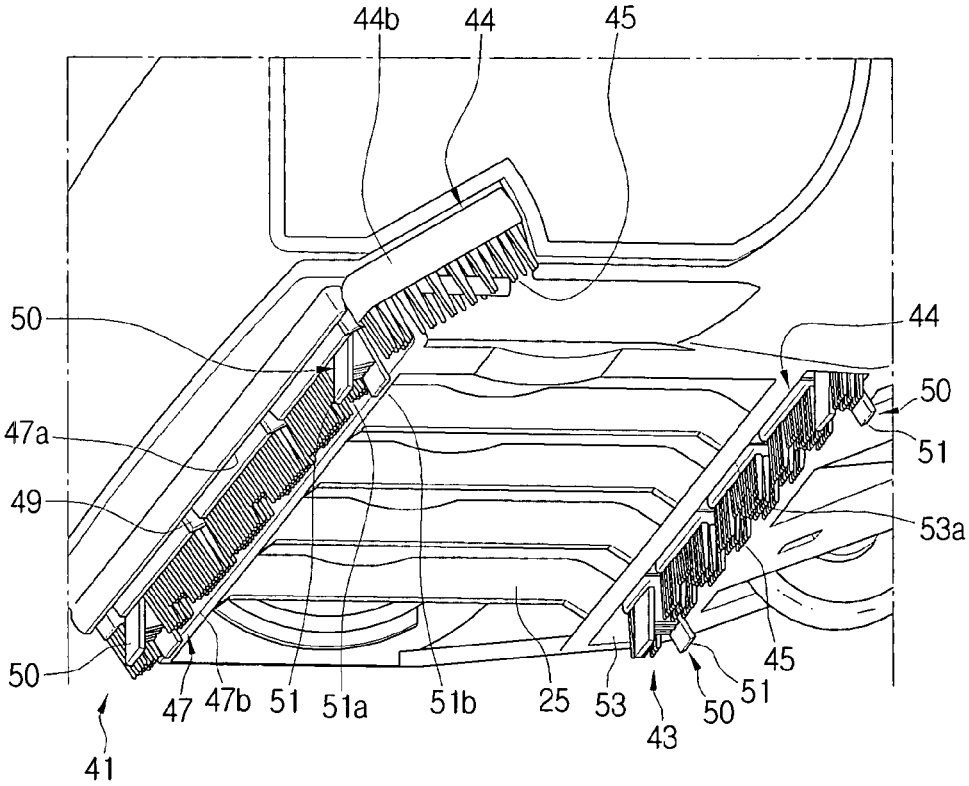

To be more specific, as illustrated in FIGS. 4A and 4B, if the user pushes the nozzle assembly body 11 of the nozzle assembly 10 in a front direction, the first contact surfaces 51*a* of the cams 51 of the first and the second movable brush members 41 and 43 come in contact with the surface to be cleaned and rotates by a predetermined angle, for example, an angle of approximately 30 degrees, in a counterclockwise direction due to a friction force thereof to the surface to be cleaned, until the second contact surfaces 51*b* are pushed no longer coming in contact with the rear wall surfaces 47*b* and 53*b* of the first and the second mounting grooves 47 and 53, respectively. As a result, the supporting parts 44 of the first and the second movable brush members 41 and 43, which fix the cams 51, are also rotated by the angle of approximately 30 degrees in the counterclockwise direction. At this time, the both ends 44*a* and 44*b* of the supporting part 44 of the first movable brush member 41 bent and extended toward the both sides of the air inlet 18 are additionally restrained from moving, by the guide groove 31. Accordingly, the brushes 45 of the first and the second movable brush members 41 and 43 come in contact with the surface to be cleaned in a state where it is inclined rearward by the angle of approximately 30 degrees. As a result, the brushes 45 do not push out dust or dirt, such as particles, adhered to the surface to be cleaned toward the outside of the nozzle assembly body 11, but scrape off only dirt, such as a hair or fur of a pet, stuck to the surface to be cleaned. At this time, large dust or dirt adhered to the surface to be cleaned is drawn in toward the air inlet 18 through the spaces above the rotation supporting surfaces 48 of the supporting parts 44 of the first and the second movable brush members 41 and 43 by the suction force of the driving motor of the cleaner body 150.

Figure 5A:
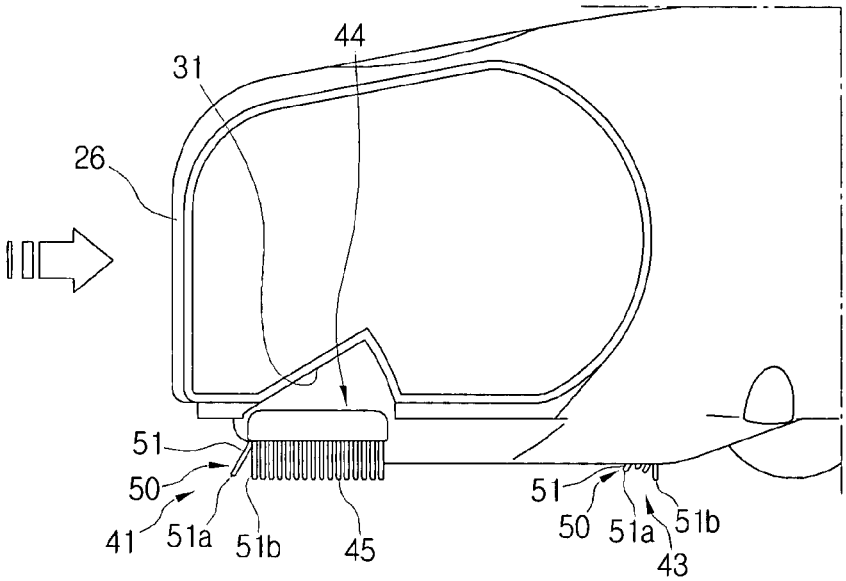
Figure 5B:
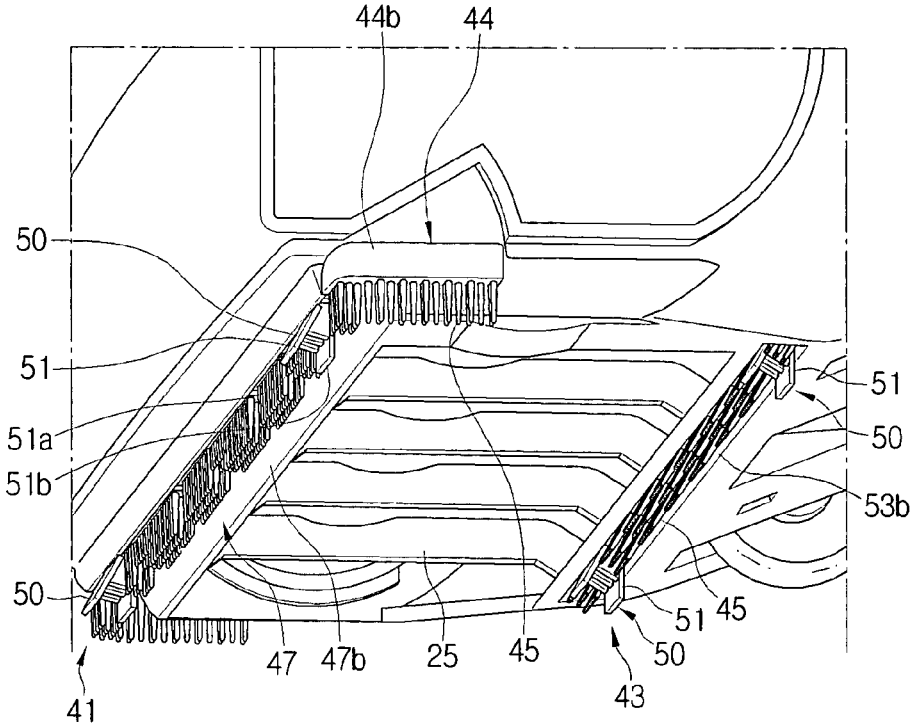

To the contrary, as illustrated in FIGS. 5A and 5B, if the user pulls the nozzle assembly body 11 of the nozzle assembly 10 in a rear direction, the second contact surfaces 51*b* of the cams 51 of the first movable brush member 41 come in contact with the surface to be cleaned and rotate by the predetermined angle, that is, the angle of approximately 30 degrees, in a clockwise direction from the position illustrated in FIGS. 4A and 4B due to a friction force thereof to the surface to be cleaned, until the first contact surfaces 51*a* are pushed no longer coming in contact with the front wall surface 47*a* of the first mounting grooves 47 and at the same time, the brush 45 of the both ends 44*a* and 44*b* of the supporting part 44 of the first movable brush member 41 comes in contact with the surface to be cleaned. As a result, the brush 45 of the supporting part 44 of the first movable brush members 41 comes in contact with the surface to be cleaned in a horizontal position, and thus gathers dust or dirt adhered to the surface to be cleaned toward the drum brush 19 and at the same time, scrapes off a hair or fur of a pet stuck to the surface to be cleaned toward the drum brush 19. Also, the supporting part 44 of the second movable brush member 43 is rotated by the predetermined angle, that is, the angle of approximately 30 degrees, in the clockwise direction until the first contact surfaces 51*a* are pushed no longer coming in contact with the front wall surface 53*a* of the second mounting grooves 53. As a result, the brush 45 of the supporting part 44 of the second movable brush members 43 comes in contact with the surface to be cleaned in a state where it is inclined forward by the angle of approximately 30 degrees and thus scrapes off only dirt, such as a hair or fur of a pet, stuck to the surface to be cleaned. At this time, large dust or dirt adhered to the surface to be cleaned is drawn in toward the air inlet 18 through the spaces above the rotation supporting surfaces 48 of the supporting parts 44 of the first and the second movable brush members 41 and 43 by the suction force of the driving motor of the cleaner body 150.

The dust or dirt, such as the particles, the hair or the fur of a pet, firstly brushed or scraped away from the surface to be cleaned by the first and the second movable brush members 41 and 43 as described above are flowed into the cleaner body 150 through the air inlet 18, the extended tube 120 and the suction hose 140 by the suction force of the suction motor in the cleaner body 150, together with dust or dirt, such as particles, a hair or fur of a pet, secondly brushed or scraped away from the surface to be cleaned by the drum brush 19 rotating by the driving motor. The air flowed into the cleaner body 150 separates the dust or dirt therefrom in the dust separating chamber and then discharges to the outside through the motor chamber.

Figure 8C:
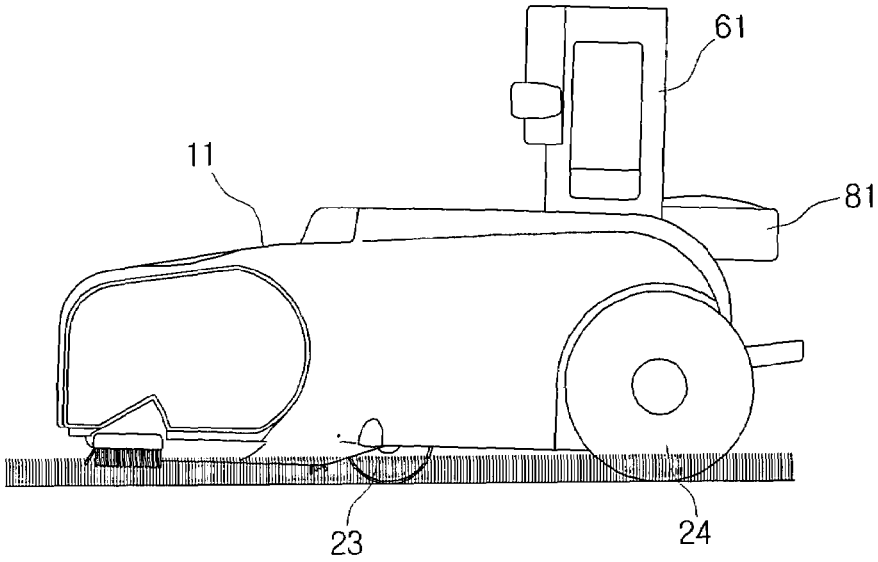
Figure 8D:
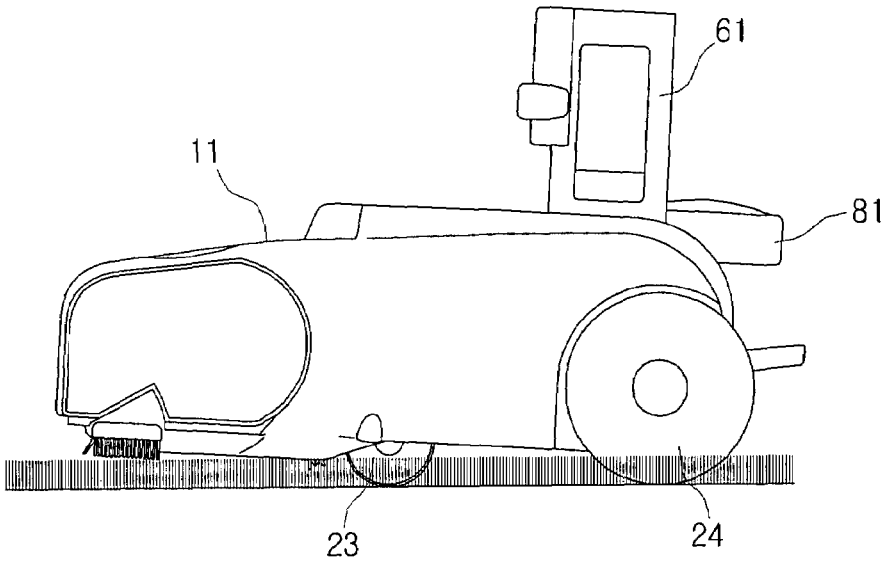

After the cleaning operation is completed as described above, if the user wants to adjust the height of the drum brush unit 17 of the nozzle assembly 10 to a height of medium (MED) or high (HI) adapted to clean a carpet as illustrated in FIGS. 8C and 8D, she or he pushes the height adjusting button 81 with her or his foot, and thus adjusts the height of the drum brush unit 17 to the height of height of medium (MED) or high (HI).

Also, if to repair the nozzle assembly 10, the user wants to separate the nozzle assembly 10 from the extended tube 120, she or he pushes the push lever 66 in a direction of arrow A of FIG. 6 with her or his foot, and then pulls the lower end 120*a* of the extended tube 120 in a direction of arrow C of FIG. 7A, as described with reference to FIG. 6 through 7B. As a result, the nozzle assembly 10 is separated from the extended tube 120.

After repairing the nozzle assembly 10, if the user wants to join the nozzle assembly 10 to the extended tube 120 again, she or he inserts the lower end 120*a* of the extended tube 120 into the upper end of the connecting pipe 61 in a direction of arrow B of FIG. 7A, in a state where she or he pushes the push lever 66 in the direction of arrow A of FIG. 6 with her or his foot. And then, the user takes away her or his foot from the push lever 66 to remove a force applied on the push lever 66. As a result, the locking pin 67 of the push lever 66 is inserted in turn into the locking holes 61*a* and 120*b*, and thus the lower end 120*a* of the extended tube 120 is locked in the upper end of the connecting pipe 61.

As apparent from the foregoing description, according to the exemplary embodiment of the present disclosure, the nozzle assembly of the vacuum cleaner has the movable brush unit installed in the front and the rear of the air inlet, that is, the drum brush. Accordingly, the nozzle assembly of the vacuum cleaner according to the exemplary embodiment of the present disclosure can firstly scrape off the dust or dirt, particularly, the hair or the fur of a pet, which is not separate from the surface to be cleaned well, through the movable brush unit and secondly brush away and scatter the scraped dust or dirt through the drum brush to be drawn into the nozzle assembly, thereby improving cleaning efficiency for the dust or dirt.

Further, the nozzle assembly of the vacuum cleaner according to the exemplary embodiment of the present disclosure has the connecting unit configured, so that the user can join or separate the nozzle assembly body to or from the connecting part, that is, the lower end of the extended tube of the cleaner body only by inserting or pulling out the extended tube into or from the connecting pipe in the state where she or he pushes the push lever with her or his foot. Accordingly, the nozzle assembly of the vacuum cleaner according to the exemplary embodiment of the present disclosure is advantageous in that the user can easily assemble or disassemble the nozzle assembly body to or from the extended tube of the cleaner body.

Furthermore, since the nozzle assembly of the vacuum cleaner according to the exemplary embodiment of the present disclosure adjusts the height of the drum brush unit only by pushing the height adjusting button, it is convenient to use. Thus, the nozzle assembly of the vacuum cleaner according to the exemplary embodiment of the present disclosure can smoothly rotate the drum brush in concert with the state or the kind of the surface to be cleaned, thereby maximizing the cleaning efficiency.

Also, the nozzle assembly of the vacuum cleaner according to the exemplary embodiment of the present disclosure is configured, so that the nozzle assembly body has the drum brush casing formed of the rubber or the plastic material of the PVC series. Accordingly, the nozzle assembly of the vacuum cleaner according to the exemplary embodiment of the present disclosure can prevent the nozzle assembly body from being damaged or scratched in a collision with the external structure, such as the obstacle during the cleaning operation.

Although representative exemplary embodiment of the present disclosure has been shown and described in order to exemplify the principle of the present disclosure, the present disclosure is not limited to the specific embodiment. It will be understood that various modifications and changes can be made by one skilled in the art without departing from the spirit and scope of the disclosure as defined by the appended claims. Therefore, it shall be considered that such modifications, changes and equivalents thereof are all included within the scope of the present disclosure.

What is claimed is:

1. A nozzle assembly of a vacuum cleaner, comprising:

a nozzle assembly body having an air inlet and an air outlet;

a drum brush unit disposed in the nozzle assembly body in the vicinity of the air inlet, and said drum brush unit having a drum brush disposed to brush away dirt or dust adhered to a surface to be cleaned while coming in rotation contact therewith; and a movable brush unit disposed in at least one of a front and a rear of the air inlet on an undersurface of the nozzle assembly body to pivot in an opposite direction to a moving direction of the nozzle assembly body thus to change a contacting angle to the surface to be cleaned in a range of a predetermined angle and then to brush away the dirt or dust adhered to the surface to be cleaned, in moving of the nozzle assembly body, wherein the movable brush unit comprises a first movable brush member disposed in front of the air inlet and a second movable brush member disposed in the rear of the air inlet.

2. The nozzle assembly as claimed in claim 1, wherein each of the first movable brush member and the second movable brush member comprises:

a supporting part rotatably supported in a first or a second mounting groove formed in the undersurface of the nozzle assembly body adjacent to the front or the rear of the air inlet and having a brush attached to an undersurface thereof; and at least one contact rotating part disposed on the undersurface of the supporting part to come in contact with the surface to be cleaned thus to rotate the supporting part in the opposite direction to the moving direction of the nozzle assembly body, in the moving of the nozzle assembly body.

3. The nozzle assembly as claimed in claim 2, wherein the supporting part comprises a plurality of rotation supporting surfaces rotatably supported in a spaced-apart relation to each other by a plurality of hinge brackets disposed in the first or the second mounting groove.

4. The nozzle assembly as claimed in claim 2, wherein the at least one contact rotating part comprises a cam fixed on the undersurface of the supporting part, so that a rotating angle thereof is restricted in the predetermined angle by a front wall surface and a rear wall surface of the first or the second mounting groove.

5. The nozzle assembly as claimed in claim 4, wherein the cam is formed in a V-lettered shape having first and second contacting surfaces formed, so that one of the first and second contacting surfaces is rotated when coming in contact with the surface to be cleaned, and wherein the other of the first and second contacting surfaces comes in contact with the front wall surface or the rear wall surface of the corresponding first or second mounting groove to restrict a rotation of the cam.

6. The nozzle assembly as claimed in claim 4, wherein the predetermined angle comprises an angle of 30 degrees.

7. The nozzle assembly as claimed in claim 2, wherein the supporting part of the first movable brush member has both ends that are bent and extended toward both sides of the air inlet.

8. The nozzle assembly as claimed in claim 7, wherein the nozzle assembly body at both sides thereof has guide grooves formed to guide the both ends of the supporting part to rotate in the predetermined angle.

9. The nozzle assembly as claimed in claim 1, wherein the nozzle assembly body comprises a drum brush casing formed of one of a rubber and a plastic material of PVC series to surround the drum brush in a front thereof.

10. The nozzle assembly as claimed in claim 9, wherein the drum brush casing comprises a transparent window to expose the drum brush to an outside.

11. A nozzle assembly of a vacuum cleaner, comprising:

a nozzle assembly body having an air inlet and an air outlet;

a drum brush unit disposed in the nozzle assembly body in the vicinity of the air inlet, and said drum brush unit having a drum brush disposed to brush away dirt or dust adhered to a surface to be cleaned while coming in rotation contact therewith;

a movable brush unit disposed in at least one of a front and a rear of the air inlet on an undersurface of the nozzle assembly body to pivot in an opposite direction to a moving direction of the nozzle assembly body thus to change a contacting angle to the surface to be cleaned in a range of a predetermined angle and then to brush away the dirt or dust adhered to the surface to be cleaned, in moving of the nozzle assembly body; and a connecting unit to connect the nozzle assembly body to a connecting part of a cleaner body, wherein the connecting unit comprises a connecting pipe connected with an air passage of the nozzle assembly body and projected upward from an upper surface of the nozzle assembly body, a push lever rotatably supported on a fixing mount formed on one side of the connecting pipe and urged to come in contact with the connecting pipe by an elastic spring, and a locking pin formed on one surface of the push lever opposed to the connecting pipe and configured to be inserted into locking holes of the connecting pipe and the connecting part.

12. The nozzle assembly as claimed in claim 1, further comprising a height adjustment unit to adjust a height of the drum brush unit according to a condition of the surface to be cleaned.

* * * * *